US009502847B2

(12) United States Patent
Sung et al.

(10) Patent No.: US 9,502,847 B2
(45) Date of Patent: Nov. 22, 2016

(54) CONNECTOR ASSEMBLY HAVING ADJUSTABLE PLUG

(71) Applicant: HON HAI PRECISION INDUSTRY CO., LTD., New Taipei (TW)

(72) Inventors: Chih-Peng Sung, New Taipei (TW); Jin-Yuan Teng, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/677,686

(22) Filed: Apr. 2, 2015

(65) Prior Publication Data

US 2016/0064884 A1 Mar. 3, 2016

(30) Foreign Application Priority Data

Sep. 1, 2014 (TW) ..... 103130085

(51) Int. Cl.
*H01R 13/44* (2006.01)
*H01R 35/00* (2006.01)
*H01R 13/66* (2006.01)

(52) U.S. Cl.
CPC ..... *H01R 35/00* (2013.01); *H01R 13/6658* (2013.01)

(58) Field of Classification Search
CPC .... H01R 31/06; H01R 27/02; H01R 13/665; H01R 13/645; H01R 13/60
USPC ..... 439/131
See application file for complete search history.

(56) References Cited

U.S. PATENT DOCUMENTS 8,308,494 B1 * 11/2012 Zhao ..... H01R 13/60 439/131
8,721,346 B2 * 5/2014 Lin ..... H05K 5/0278 439/10
2006/0141842 A1 * 6/2006 Sauer ..... H01R 13/645 439/344

FOREIGN PATENT DOCUMENTS

CN 1316690 C 5/2007
CN 201178173 Y 1/2009
TW M426181 U1 4/2012
TW I412192 B 10/2013

* cited by examiner

*Primary Examiner* — Jean F Duverne
(74) *Attorney, Agent, or Firm* — Zhigang Ma

(57) ABSTRACT

A connector assembly includes a main body, a plug, and a positioning base mounted to the main body and engaged with the plug. The plug includes at least one pin and a plurality of first latching portions. The positioning base includes a plurality of second latching portions corresponding to the first latching portions. The second latching portions are selectively engaged with the first latching portions in a first relationship to secure the plug on the positioning base at a first orientation with respect to the positioning base, when the second latching portions are engaged with the first latching portions in a second relationship different to the first relationship, the plug is located at a second orientation different from the first orientation with respect to the positioning base from the positioning base.

20 Claims, 6 Drawing Sheets

CONNECTOR ASSEMBLY HAVING ADJUSTABLE PLUG

FIELD

The subject matter herein relates to a connector assembly, and more particularly to a connector assembly having an adjustable plug.

BACKGROUND

A connector assembly includes a body and a plug detachably mounted on the body. The body includes a hook. The plug includes a housing, a plurality of pins mounted on the housing, and a groove defined on the housing. The hook is engaged with the groove to secure the plug in the body.

BRIEF DESCRIPTION OF THE DRAWINGS

Implementations of the present technology will now be described, by way of example only, with reference to the attached figures, wherein.

DETAILED DESCRIPTION

Figure 1:
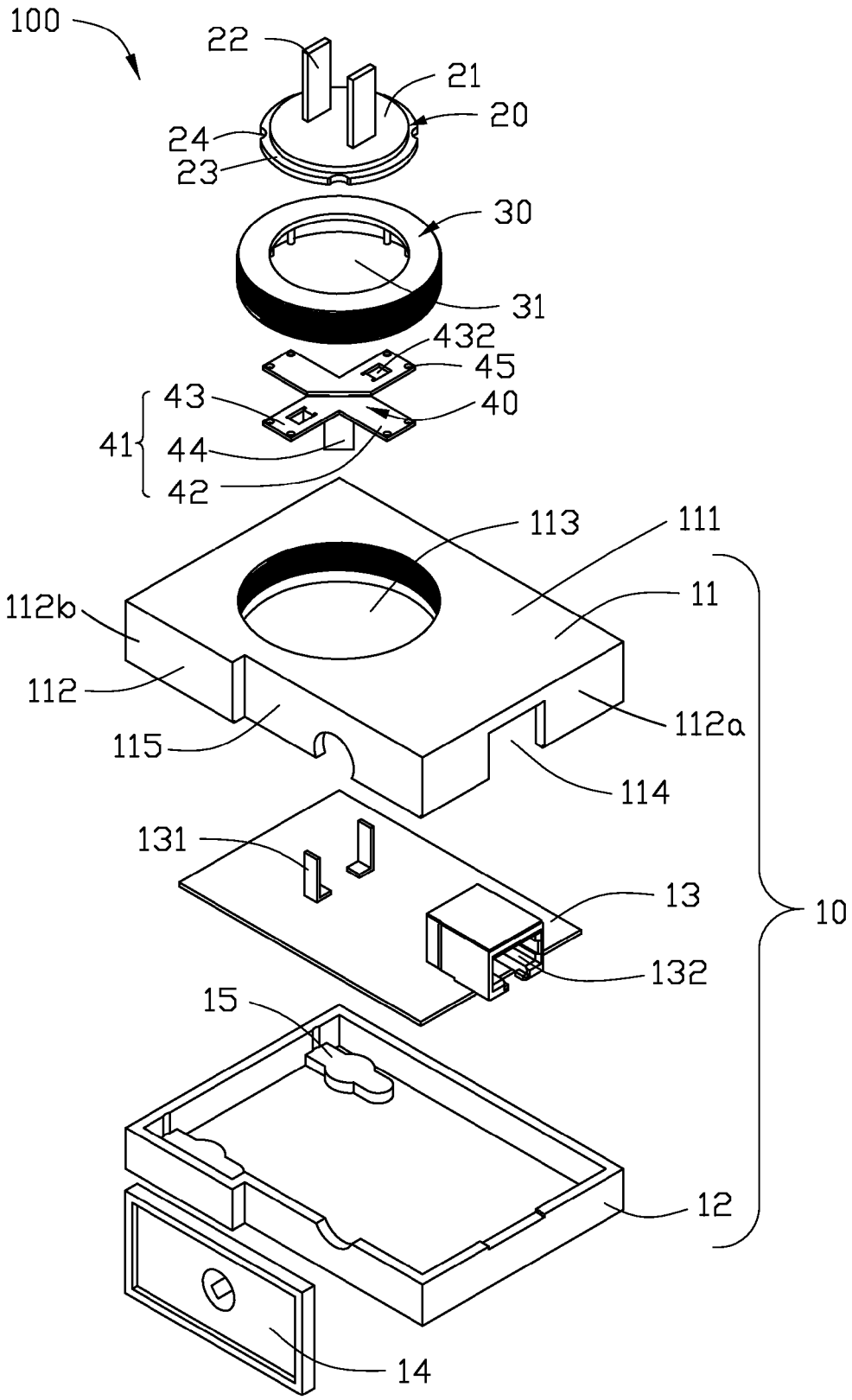
FIG. 1 is an exploded, isometric view of a connector assembly having a changeable plug, the connector assembly includes a plug, a positioning base, and a contact.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The subject matter herein is described in relation to a connector assembly having an adjustable plug.

FIG. 1 illustrates an embodiment of a connector assembly 100. The connector assembly 100 includes a main body 10, a plug 20, and a positioning base 30. The plug 20 is rotatably mounted to the positioning base 30. The positioning base 30 is detachably secured on the main body 10. A contact 40 is received in the positioning base 30. One end of the contact 40 is coupled to the plug 20, and another end of the contact 40 resists the main body 10. The plug 20 and the contact 40 are received in the positioning base 30. In this embodiment, a cable (not shown) is detachably connected with the connector assembly 100. In other embodiments, a cable is non-detachably connected to the connector assembly 100. The connector assembly 100 is electrically connected to an electronic device (not shown) via the cable, and electrically connected to a power socket (not shown) coupled to a power supply (not shown) via the plug, so as to provide power to electronic device. The electronic device may be a mobile phone, a personal digital assistant (PDA), a portable computer and so on.

The main body 10 includes a top cover 11, a bottom cover 12 opposite to the top cover 11, a circuit board 13 received in the bottom cover 12, and a supporting member 14 coupling the top cover 11 to the bottom cover 12. The circuit board 13 converts voltages from the power socket into a predetermined voltage for the electronic device.

The top cover 11 includes a rectangular top portion 111 and four side walls 112*a*-112*d* perpendicular to the top portion 111. The top portion 111 defines a screw hole 113. The side wall 112*a* defines a groove 114, the sidewall 112*b* adjacent to the sidewall 112*a* defines a recess 115 for receiving the supporting member 14. The sidewall 112*c* is adjacent to the sidewall 112*a* and opposite to the sidewall 112*b* (see FIG. 3). The sidewall 112*d* (not shown) is adjacent to the sidewall 112*c* and opposite to the sidewall 112*a*. The bottom cover 12 includes a bottom portion 121 (see FIG. 6), the side walls 112*a*-112*d* perpendicularly extend upward from the bottom portion 121. The top cover 11 and the bottom cover 12 define a receiving room for receiving the circuit board 13. The circuit board 13 includes a pair of first resilient sheets 131 and an electronic connector 132. The first resilient sheets 131 are "L" shape. An end of the first resilient sheet 131 is perpendicular to the circuit board 13 and electrically coupled to the circuit board 13. The receiving portion 132 protrudes from the circuit board 13. When the top cover 11 is fixed on the bottom cover 12, the electronic connector 132 is out of the main body 10 via the groove 114. In the illustrated embodiment, the supporting member 14 is rotatably fixed on the top cover 11 and the bottom cover 12, and located in the recess 115. The recess 115 is configured to secure and support the main body 10.

The plug 20 includes a head portion 21 and at least one pin 22 perpendicularly extending upward from the head portion 21. The head portion 21 is in a shape of a disk. A flange 23 extends from the head portion 21 and two pairs of first latching portions 24 are located on the flange 23. The latching portions 24 are recesses defined in the flange 23. The first latching portions 24 divide the head portion 21 into four equal parts. The pins 22 electrically couple to the first resilient sheet 131 of the circuit board 13.

Figure 2:
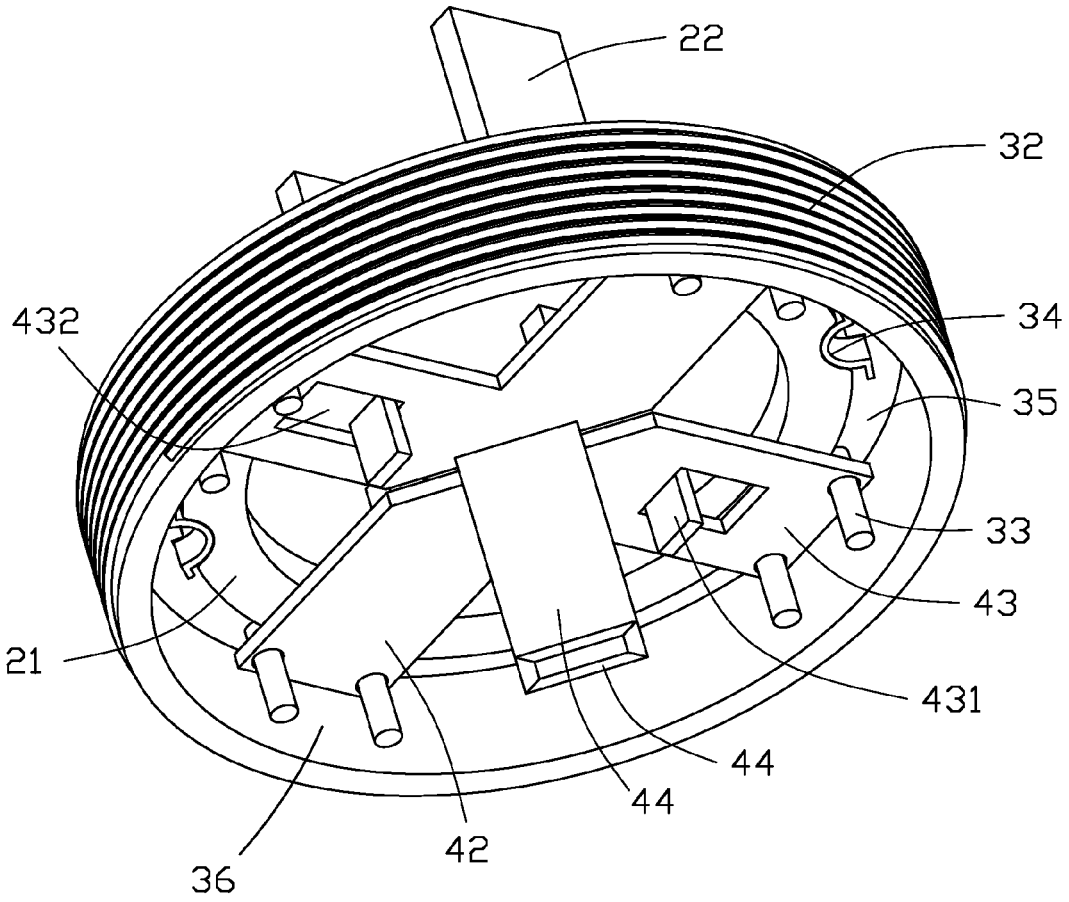
FIG. 2 is an isometric view of the plug is assembled on the positioning base and the contact of FIG. 1.

FIG. 2 illustrates that the positioning base 30 is a hollow cylinder. The positioning base 30 defines a receiving hole 31. The receiving hole 31 is located at a center of the position base 30. A screw thread 32 protrudes from the outside surface of the positioning base 30. A combining portion 35 is located on an inner surface 36 of the positioning base 30 surrounding the receiving hole 31. The screw thread 32 is engaged with the screw hole 113 securing the positioning base 30 on the main body 10. The positioning base 30 further includes a plurality of pillars 33 and a plurality of second latching portions 34. The pillars 33 and the second latching portions 34 extend from the combining portion 35 toward the circuit board 13. In the illustrate embodiment, the number of the first latching portions 24 is more than that of the second latching portions 34. The second latching portions 34 are selectively engaged with the first latching portions 24 to secure the plug 20 on the positioning base 30, when the second latching portions 34 are engaged with different first latching portions 24, the plug 20 is located at different orientations with respect to the positioning base 30. In the illustrated embodiment, the plug 20 is passed through the receiving hole 31 and retracted into the receiving hole 31 until the flange 23 is resisted in the receiving hole 31 of the positioning base 30. The plug 20 can be rotated 90 degrees with respect to the positioning base 30 under an external force and the first latching portion 24 is latched with the corresponding second latching portion 34 to fix the plug 20 on the second latching portion 34 of the positioning base 30. The pins 22 electrically couple to the contact 40 via the first resilient sheets 131.

The contact 40 includes a pair of conductors 41. Each of the conductors 41 includes a first extending arm 42, a second extending arm 43 coupling to the first extending arm 42, and a supporting arm 44 perpendicularly extending downward from the first extending arm 42 and the second extending arm 43 to support the conductor 41. The first extending arm 42 and the second extending arm 43 are crossing each other and mounted on the positioning base 30. The first extending arms 42 of the pair of the conductors 41 are in a straight line. The second extending arms 43 of the pair of the conductors 41 are in a straight line. The supporting arms 44 are two parallel conductive boards, which perpendicularly extend downward from the flat of the first extending arm 42 and the second extending arm 43 to the circuit board 13. The supporting arms 44 are fixed on the circuit board 13. The supporting arms 44 are used for polar separation and prevent a short circuit to the connector assembly 100.

Each of the first extending arms 42 and the second extending arms 43 defines two installation holes 45. The contact 40 is fixed on the positioning base 30 via the pillars 33 engaging with the installation holes 45. A second resilient sheet 431 perpendicularly extends downward from each of the second extending arm 43 and an opening 432 is defined on the second extending arm 43. The pins 22 of the plug 20 are electrically coupled to the first extending arm 42 or the second extending arm 43. The second resilient sheet 431 is electrically coupled to the first resilient sheet 131 of the circuit board 13 electrically coupling the plug 20 to the circuit board 13 of the main body 10. In the illustrated embodiment, the first extending arm 42, the second extending arm 43, and the supporting arm 44 are integrally molded. The number of the first resilient sheets 131 is same as the number of conductors 41, and the number of the conductors 41 is same as the number of pins 22.

Figure 3:
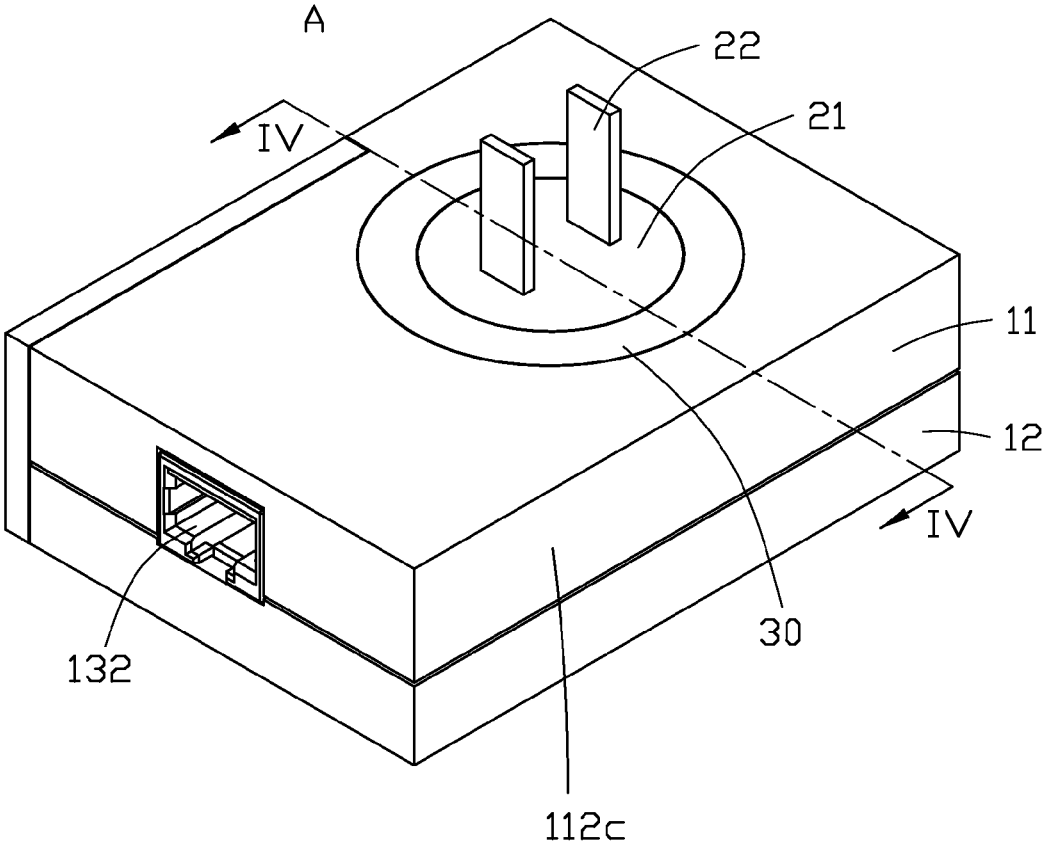
FIG. 3 is an isometric view of the connector assembly of FIG. 1.
Figure 4:
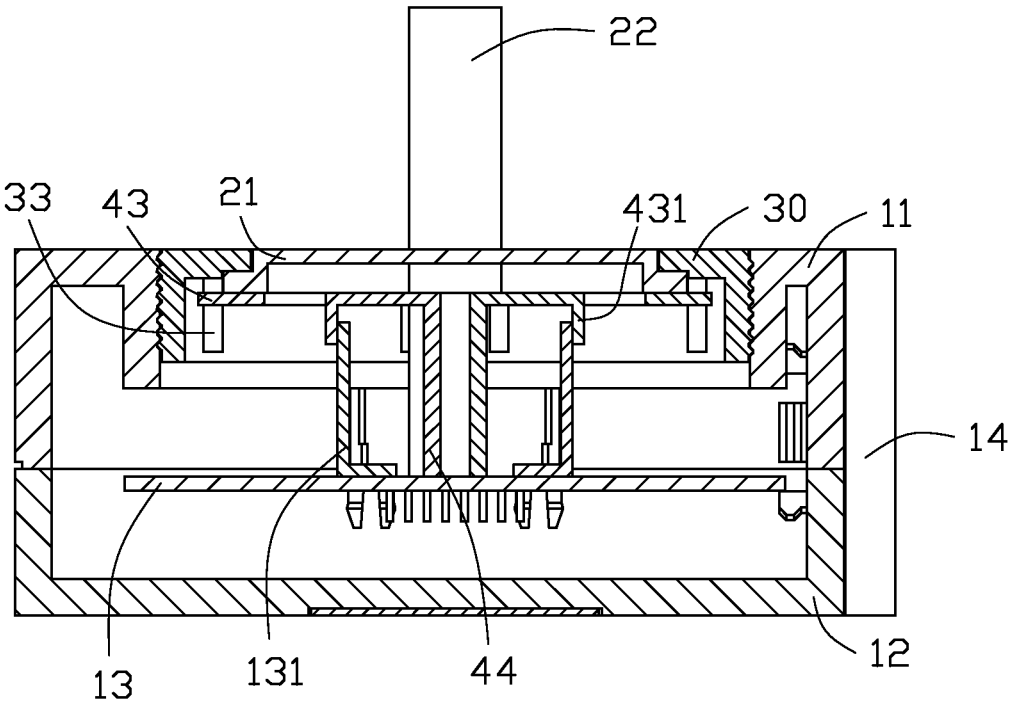
FIG. 4 is a partial cross-sectional view taken along IV-IV of the connector assembly of FIG. 3.

FIGS. 3-4 illustrate when in assembly, first, the plug 20 is mounted on the positioning base 30. In detail, the plug 20 is passed through the positioning base 30 and received in the positioning base 30 when the flange 23 is resisted in the receiving hole 31. The plug 20 is rotated until the first latching portions 24 latch with the corresponding second latching portions 34 fixing the plug 20 to the body 10. The receiving hole 45 of the contact 40 engages with the pillars 33 of the positioning base 30 to mount the contact 40 on the positioning base 30 opposite to the plug 20. The pins 22 of the plug 20 are electrically coupled to the first extending arm 42 or the second extending arm 43. In other words, when the second latching portions 34 are selectively engaged with the first latching portions 24 in a first relationship to secure the plug 20 to the positioning base 30 and to make the pins 22 electrically couple to the first extending arm 42 at a first orientation A with respect to the positioning base 30. When the second latching portions 34 are engaged with the first latching portions 24 in a second relationship different to the first relationship, the plug 20 is located at a second orientation B (see FIG. 5) different from the first orientation A and the pins 22 are electrically coupled to the second extending arm 43. The plug 20, positioning base 30, and the contact 40 are passed through the screw hole 113 of the main body 10. The screw thread 32 of the positioning base 30 is threaded with the screw hole 113 to fix the positioning base 30 to the main body 10. The second resilient sheet 431 of the contact 40 is contacted with the first resilient sheet 131 of the circuit board 13 to make the plug 20 electronically connect to the circuit board 13. The supporting arm 44 is resisted in the circuit board 13 to stably support the plug 20 in the main body 10.

Figure 5:
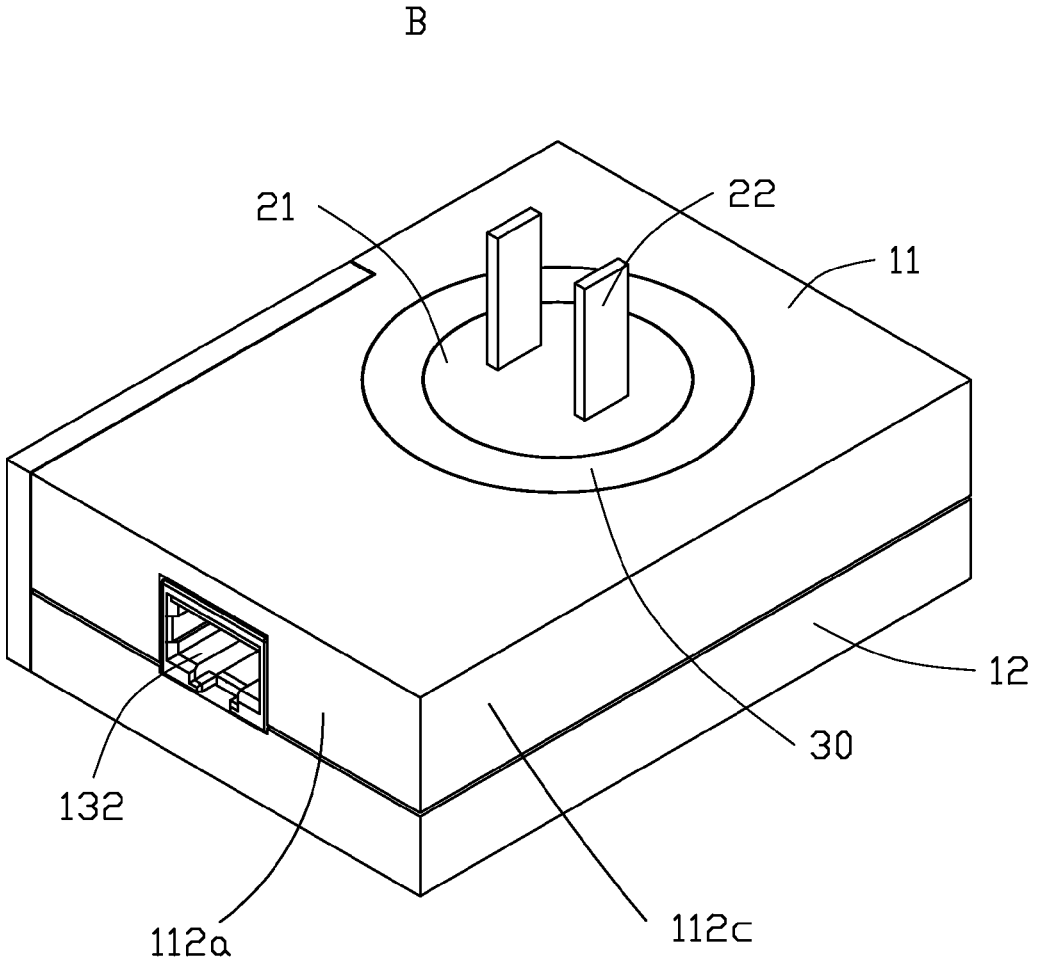
FIG. 5 is an isometric view of the connector assembly that the plug is rotated by 90 degree in FIG. 3.

FIG. 5 illustrates that the plug 20 can be rotated 90 degrees with respect to the main body 10. In other embodiments, the number of plugs 20 can be three and the structure can be suitable to different national standards.

Figure 6:
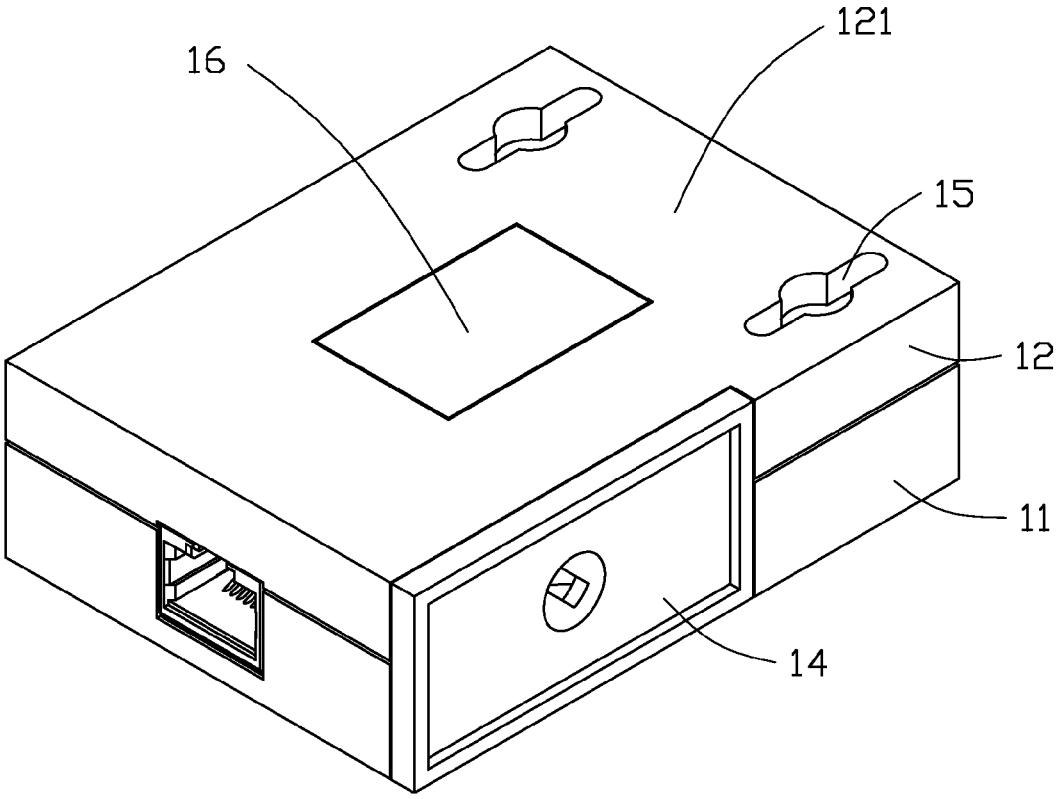
FIG. 6 is an isometric view of the connector assembly of FIG. 3 viewed from a bottom side.

FIG. 6 illustrates that a pair of hanging holes 15 is defined on a bottom of the main body 10. The pair of hanging holes 15 is used to hang the main body 10 on a wall. The bottom of the main body 10 further includes an adhesive portion 16. The adhesive portion 16 pastes the main body 10 to the wall.

The embodiments shown and described above are only examples. Many details are often found in the art such as the other features of a connector assembly having adjustable plug. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. connector assembly, comprising:

a main body;

a plug comprising at least one pin and a plurality of first latching portions;

a positioning base mounted to the main body and engaged with the plug, the positioning base comprising a plurality of second latching portions corresponding to the first latching portions; and a contact fixed in the positioning base and electronically coupled to the at least one pin;

wherein the second latching portions are selectively engaged with the first latching portions in a first relationship to secure the plug on the positioning base at a first orientation with respect to the positioning base, when the second latching portions are engaged with the first latching portions in a second relationship different to the first relationship, the plug is located at a second orientation different from the first orientation with respect to the positioning base from the positioning base.

2. The connector assembly of claim 1, wherein the positioning base defines a receiving hole, the plug is passed through the receiving hole and selectively latched with the second latching portions.

3. The connector assembly of claim 1, wherein the contact comprises a pair of conductors, each of the conductors comprises a first extending arm, a second extending arm coupling to the first extending arm, and a supporting arm extending from downward from the first extending arm and the second extending arm to support for the conductor.

4. The connector assembly of claim 3, wherein the first extending arm and the second extending arm are mounted on the positioning base and crossed with each other, the supporting arm is perpendicular to the first extending arm and the second extending arm.

5. The connector assembly of claim 4, wherein the first extending arms of the conductors are in a straight line and adjacent to each other, and the second extending arms of the conductors are in a straight line and adjacent to each other.

6. The connector assembly of claim 4, wherein the supporting arms of the conductors are parallel to each other and perpendicular to the corresponding first extending arms and the second extending arms.

7. The connector assembly of claim 6, wherein the number of the number of the first latching portions is more than the second latching portions and the number of the conductor is same with the pins.

8. A connector assembly, comprising:

a main body;

a circuit board received in the main body;

a plug comprising at least one pins and a plurality of first latching portions;

a positioning base supporting for the plug, the positioning base comprising a plurality of second latching portions corresponding to the first latching portions; and a contact fixed in the positioning base and electrically coupled the plug to the circuit board;

wherein the second latching portions are selectively engaged with the first latching portions in a first relationship to secure the plug on the positioning base at a first orientation with respect to the positioning base, when the second latching portions are engaged with the first latching portions in a second relationship different to the first relationship, the plug is located at a second orientation different from the first orientation with respect to the positioning base from the positioning base.

9. The connector assembly of claim 8, wherein the positioning base defines a receiving hole, the plug is passed through the receiving hole and selectively latched with the second latching portions.

10. The connector assembly of claim 8, wherein the contact comprises a pair of conductors, each of the conductors comprises a first extending arm, a second extending arm coupling to the first extending arm, and a supporting arm extending from downward from the first extending arm and the second extending arm to support for the conductor.

11. The connector assembly of claim 10, wherein the first extending arm and the second extending arm are mounted on the positioning base and crossed with each other, the supporting arm is perpendicular to the first extending arm and the second extending arm.

12. The connector assembly of claim 11, wherein the first extending arms of the conductors are in a same straight line and adjacent to each other, and the second extending arms of the conductors are in a same straight line and adjacent to each other.

13. The connector assembly of claim 12, wherein the supporting arms of the conductors are parallel to each other and perpendicular to the corresponding first extending arms and the second extending arms.

14. The connector assembly of claim 13, wherein the number of the number of the first latching portions is more than the second latching portions and the number of the conductor is same with the pins.

15. The connector assembly of claim 8, wherein the main body defines a screw hole, the positioning base further defines screw thread, one of the screw hole and the screw thread is internal thread, the other one of the screw hole and the screw thread is external thread, and the positioning portion is fixed on the main body via the screw hole is meshed with the screw thread.

16. The connector assembly of claim 8, wherein the circuit board comprises a pair of first resilient sheets, the first resilient sheet is perpendicular to the circuit board and electrically coupled to the circuit board.

17. The connector assembly of claim 16, wherein a second resilient sheet perpendicular extends downward from each of the second extending arm, and the second resilient sheet is electrically coupled to the first resilient sheet when the contact is fixed on the circuit board.

18. The connector assembly of claim 17, wherein the positioning base further comprises a plurality of pillars opposite to the plug, the contact defines a plurality of installing holes on the first extending arm and the second extending arm, and the contact is fixed on the positioning base via the installing holes engage with the pillars.

19. The connector assembly of claim 18, wherein when the plug and the contact are fixed on the positioning base, the pins of the plug are electrically coupled to the first extending arm to make the pins to be electrically coupled to the first resilient sheet; when the plug is rotated with respect to the positioning base at different orientations, the pins of the plug are electrically coupled to the second extending arm to make the pins to be electrically coupled to the first resilient sheet.

20. A connector comprising:

a housing having a front face, the housing defining a substantially enclosed interior space and the front face including a defined screw hole extending through the front face to the enclosed interior space;

a first element positioned substantially within the defined interior space and including an accessible electronic connector;

a positioning base mounted in the front face defined screw hole;

a plug having at least one plug pin, the plug being movably engaged with the positioning base; and a contact fixed in the positioning base and electronically coupled to a circuit board received in the main body;

wherein, the plug is movable from a first position relative the positioning base to a second position relative the positioning base; and wherein, the plug is electrically connected to the electronic connector through the first element in the first position and in the second position.

* * * * *